United States Patent [19]

Behrend

[11] Patent Number: 4,458,463

[45] Date of Patent: Jul. 10, 1984

[54] UNIVERSALLY ADJUSTABLE BUILDING SUPPORTS

[76] Inventor: Herbert W. Behrend, 11 June Terr., Lake Forest, Ill. 60045

[21] Appl. No.: 402,789

[22] Filed: Jul. 28, 1982

[51] Int. Cl.[3] ..... E04G 17/00

[52] U.S. Cl. ..... 52/295; 248/354.3

[58] Field of Search ..... 52/292, 295, 122.1, 52/126.7, 126.6, 126.5, 263, 295, 704; 248/354 S, 354 R, 656, 679

[56] References Cited

U.S. PATENT DOCUMENTS

| | | | |
|---|---|---|---|
| 2,280,220 | 4/1942 | Crosby | 52/126.6 |
| 2,812,834 | 11/1957 | Le Jeune | 52/295 |
| 3,096,065 | 7/1963 | Horne | 248/354 S |
| 3,397,494 | 8/1968 | Waring | 52/126.7 |
| 3,606,231 | 9/1971 | Kilborn | 52/149 |
| 3,704,560 | 12/1972 | Ratliff | 52/126.7 |
| 3,713,259 | 1/1973 | Tkach | 52/126.6 |
| 3,830,024 | 8/1974 | Warnke | 52/126.6 |
| 3,963,210 | 6/1976 | Macklin | 52/295 |
| 4,064,668 | 12/1977 | Carter | 52/263 |
| 4,345,734 | 8/1982 | Studinger | 248/354 R |

FOREIGN PATENT DOCUMENTS

| | | | |
|---|---|---|---|
| 2507577 | 8/1975 | Fed. Rep. of Germany | 248/354.4 |

*Primary Examiner*—James L. Ridgill, Jr.
*Attorney, Agent, or Firm*—David D. Kaufman

[57] ABSTRACT

An adjustable support for manufactured buildings or the like for anchoring and levelling such buildings to a solid foundation such as a concrete slab. The support comprises a lower shaft formed by three triangularly positioned threaded bolts which cooperates telescopically with an upper shaft formed by a stanchion attachable to the building. The stanchion is capable of lateral and angular rotational movement as well as vertical movement relative to the bolts so that all stresses on the stanchion can be readily compensated for.

10 Claims, 4 Drawing Figures

UNIVERSALLY ADJUSTABLE BUILDING SUPPORTS

BACKGROUND OF THE INVENTION

This invention relates to foundations and supports for manufactured structures, such as mobile homes, and more particularly to a support member for manufactured structures which is capable of universal adjustability.

In their early stages of development and use, mobile homes were appropriately named because of the impermanent or temporary manner in which they were positioned. Frequently, such homes were simply set down upon suitably positioned cement blocks. In order to achieve level, or maintain level after initial positioning, various types of shims were employed between the blocks and the underframe of the home. The obvious shortcomings and dangers inherent in that kind of mounting led to numerous attempts at achieving greater stability and adjustability of levelling.

Included among the early efforts at more effective anchoring and stabilizing supports were devices employing guys, saddles and foldable arrangements which were physically a part of the mobile home. By and large, those devices were merely wedged or supported between the building structure and the ground and did little to change the temporary nature of the structure's mounting. Representative examples of such efforts may be seen in U.S. Pat. Nos. 3,606,231; 3,704,560 and 3,096,065.

Another attempt involved the use of vertically adjustable supports mounted on concrete pillars and clamped to the structural members of the building as shown in U.S. Pat. No. 3,830,024. In that scheme, tie-down straps going completely around the building were also employed to withstand high winds and gales. The tie-down straps were objectionable for esthetic reasons in addition to the fact that they imposed additional stresses and frictional wear points on the building.

More recent attempts at improved stabilization, anchoring and precision levelling have resulted in forms of mounting which have made the manufactured structures truly more permanent than mobile. This development is the outgrowth of a number of socio-economic as well as technological factors. As the number of manufactured buildings has increased, municipalities have adopted and enforced stricter building code standards regarding such matters as foundations, permanence of anchoring and ability to withstand excessive natural forces such as high winds, tornados and earthquakes. Concomitantly, lending institutions frequently have insisted that manufactured buildings literally become part of the real estate in order to qualify for mortgage financing and the like. As might be expected, the need for greater permanence has given rise to a new generation of proposed solutions.

Representative examples of the more recent proposals may be seen in U.S. Pat. Nos. 3,713,259; 4,064,668 and 4,125,975. Those patents teach devices having bottom portions that are permanently anchored or embedded in a concrete foundation which may comprise a slab or a series of piers. Cooperating with the embedded portion was a vertically adjustable member, such as a bolt or turnbuckle, carrying at its top a means for attachment to the underframe of the manufactured building. Ostensibly, those vertically adjustable and permanently anchored support devices satisfied all requirements for manufacture building supports. However, experience with their use has shown that they are less than completely satisfactory. The problems attendant the use of those devices may be said to relate to the fact that they provide only what may be termed single point support and uni-dimensional vertical adjustability.

Typically, the underframe members of a manufactured building involved in anchoring comprise a pair of steel beams (usually I-beams) or, in the case of an extra-width building, four such beams. While a steel I-beam may be assumed to be perfectly rigid, those skilled in the art understand that it is not. Of course, the manufactured building is most obviously a non-rigid structure. Indeed, the underlying concrete slab itself is non-rigid, being subject to crystalline changes and deformations of expansion and contraction caused by weathering, temperature changes and movements of the underlying soil.

Ideally, a state of equilibrium should exist between the manufactured building and its support, that is, the weight of the structure should be evenly distributed at every point along the supporting foundation. Obviously, the load at any given point in the building varies depending upon the positioning therein of furniture, appliances, etc. With the described single point support of the prior art devices, it was difficult, if not impossible, to approximate the desired state of equilibrium even in the initial placement of the building. Without the use of scientific measuring instruments, it was virtually impossible to equalize the tension between the multiple supporting devices under the building.

Assuming that a relatively stress-free and level anchoring was achieved with the prior art devices, the maintaining of that near-equilibrium state became an even more serious problem. Over any extended period of time, the alluded to changes and stresses caused by weathering, soil heave, temperature changes, building shift, and the like, invariably cause building stresses which could result in structural damage. Under such conditions, it was again virtually impossible to make the necessary adjustments for re-establishment of the equilibrium state with the prior art devices.

SUMMARY OF THE INVENTION

The present invention provides a building support which, in large measure, overcomes all of the problems described hereinabove. In its broadest sense the invention comprises a triangular or three-point support which is permanently embedded in a concrete foundation. The three-point support carries a stanchion which in turn is connected to the I-beam of the building. The three-point support is vertically adjustable so that the stanchion may be said to be telescopically supported therein. In addition, the three-point support is designed to permit some lateral and angular rotational movement of the stanchion. The stanchion thus may be considered to be universally adjustable and able to compensate for all stresses acting thereon.

In engineering terms, a three-point support is said to be structurally determinate and free of internal strains. Because of this, the adjustment means of the invention provides an accurate indicator or measurement of the external forces acting on the support. The invention thus enables sensitive adjustments to be made with a simple wrench or other hand tool and the desired state of equilibrium achieved by estimating the hand force applied to make the adjustment.

The invention is very simple to attach to the building structure and, in a preferred form thereof, is attached to the I-beam with a single clamping or crimping operation and a welded joint.

The achievement of equilibrium and fine adjustments required therefor are readily accomplished by hand without the need for any special tools.

The support is extremely durable and efficient and yet is inexpensively made with common and readily available parts.

Other features and advantages of the invention will be apparent from the following description and claims and are illustrated in the accompanying drawings which show structure embodying preferred features of the present invention and the principles thereof.

DETAILED DESCRIPTION OF THE INVENTION

Figure 1:
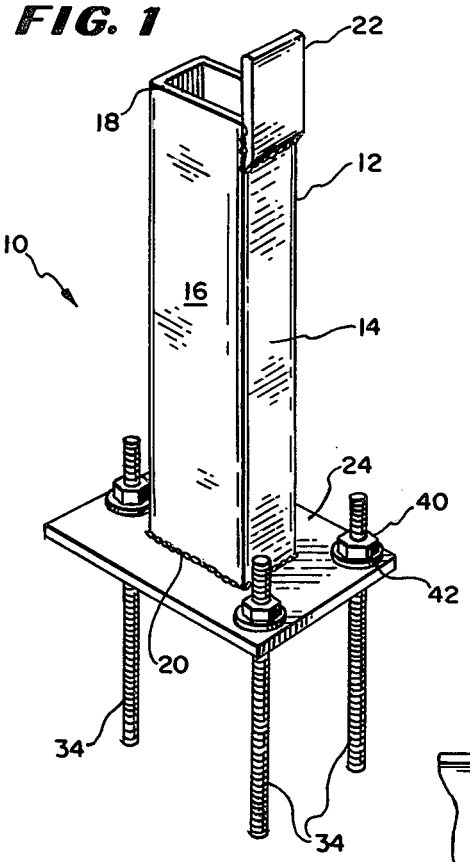
FIG. 1 is a perspective view of a universally adjustable building support embodying the principles of the invention.

Referring with greater particularity to the various Figures of the drawings, it will be seen that the reference character 10 indicates generally a universally adjustable building support embodying the principles of the invention. The building support 10 comprises an upper shaft or stanchion 12 which is attachable to the I- or other similar beam secured to the bottom of a manufactured building. In its preferred form, stanchion 12 comprises a rectangular steel tube having end walls 14 and 15, side walls 16, 16, a top edge 18 and a bottom edge 20. Connector means comprising a fastener or tongue 22 is welded or otherwise permanently secured to end wall 14 and extends above the stanchion top edge 18. For maximum strength and gripping force, the width of the fastener 22 is substantially the same as the end wall 14.

A connector or mounting plate 24 is permanently welded to the bottom edge 20 of the stanchion 12. As seen in the various Figures of the drawings, mounting plate 24 is of complementary configuration but larger dimensions than the stanchion 12, thereby providing end borders 26 and 27 and side borders 28, 28, around the centrally positioned stanchion 12. A pair of mounting holes 30, 30, is formed in end border 26 adjacent the opposite ends thereof and in proximity to the end wall 14 of the stanchion 12. A similar mounting hole 30 is formed in the end border 27 at its approximate midpoint and adjacent the end wall 15 of the stanchion 12. It will thus be appreciated that the mounting holes 30 define a substantially isosceles triangle in which said holes surround or circumscribe the stanchion 12, with the base of said triangle being substantially parallel to the stanchion end wall 14.

Figure 2:
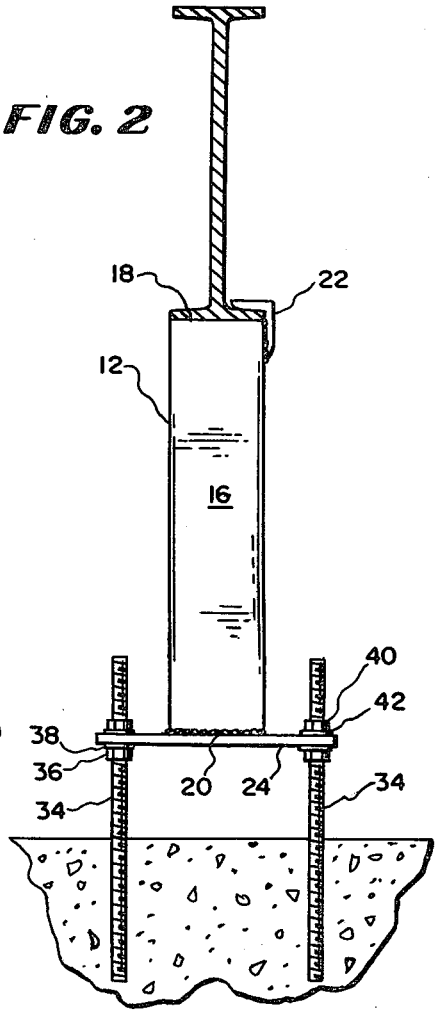
FIG. 2 is a side elevational view of the support shown attached to the I-beam of a manufactured building and embedded in a concrete slab foundation.
Figure 4:
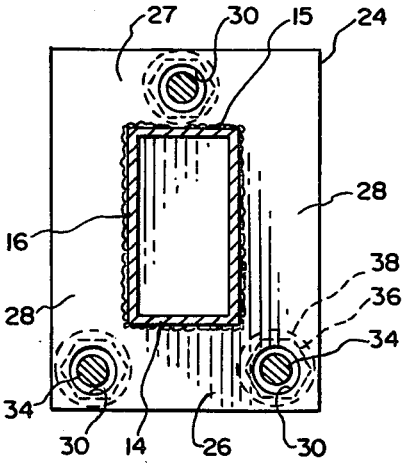
FIG. 4 is a sectional view taken on the plane of line 4—4 in FIG. 3 with the lock nuts and their respective washers removed for clarity of illustration.
Figure 3:
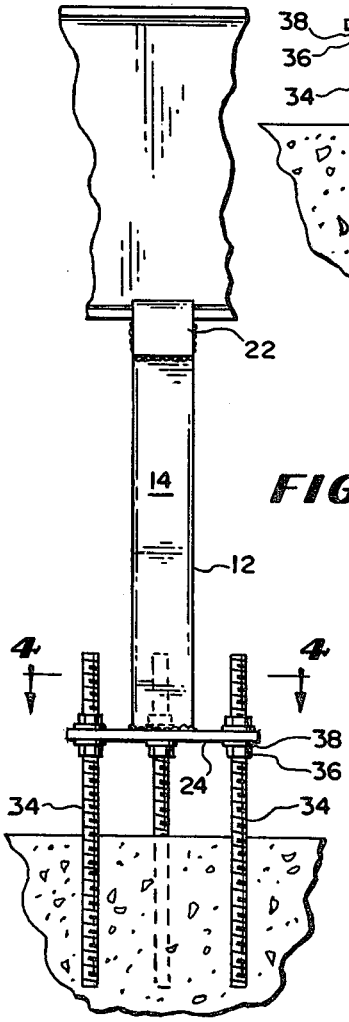
FIG. 3 is an end elevational view thereof.

Three threaded support bolts 34 are positioned through the mounting holes 30 and said bolts are adapted to be permanently anchored in the concrete foundation as indicated in FIGS. 2 and 3 of the drawings. It is important to note that the diameter of the bolts 34 is smaller than that of the holes 30 so that relative lateral and angular rotational movement therebetween is possible (see FIG. 4). In the embodiment illustrated, the bolts 34 have a diameter of $\frac{1}{2}$ inch while the diameter of the holes 30 is $\frac{7}{8}$ inch.

A support nut 36 is threadedly mounted on each bolt 34 and has associated therewith a support washer 38, said support nut and washer being positioned below the mounting plate 24 and adapted to support the same. A lock nut 40 is mounted on each bolt 34 above the mounting plate 24 and has associated therewith a washer 42. The washers 38 and 42 are sized proportionately to cooperate with the bolts 34 and holes 30 and, in the embodiment illustrated, have an outer diameter of $1\frac{3}{8}$ inch and a hole diameter of $\frac{5}{8}$ inch.

Installation and operation of the support 10 for a given manufactured building may now be fully appreciated. On the average, there are 24 supports 10 for each installation, one per every 8 lineal feet per I-beam per manufactured building. The support bolts 34 of the properly positioned supports 10 are initially embedded or anchored in the concrete foundation so that the mounting plates 24 are substantially parallel to the surface of said foundation. After the building I-beams are lowered onto the top edges 18 of the multiple supports 10, the fastener 22 of each support is bent, as by hammering or a suitable crimping tool, into tight, overlying engagement with the I-beam and then field welded thereto.

Levelling is achieved by first loosening all three lock nuts 40 of a support 10. The three support nuts 36 are then screwed up or down until the hand force required to tighten all three nuts against the bottom surface of the mounting plate 24 is substantially the same. This type of fine adjustment by estimate of hand force is quite readily made with use of a simple wrench. The result is a substantially stress-free three-point support in that device, after which the lock nuts 40 are re-tightened. The same procedure is repeated for each of the other supports 10 so that the cumulative effect is a state of substantial equilibrium and strain-free support for the entire building.

Periodic maintenance of the equilibrium or relevelling as dictated by use and environmental circumstance is just as readily accomplished in the same manner as described for the initial emplacement. In each case, whether raising or lowering of a particular stanchion 12 is required, the lock nuts 40 are first loosened and then the support nuts 36 adjusted to the same tension throughout. It will of course be noted that because of the cooperation of the differentially sized bolts 34 and mounting holes 30 the plate 24 and stanchion 12 have the capability of limited lateral and angular rotational movement about a horizontal axes as required by the stresses thereon to achieve or approximate the state of equilibrium. It will be observed that the three support rods 30 comprise in effect a lower shaft within which the stanchion cooperates telescopically to effectuate the described universal movement.

While a preferred embodiment has been illustrated and described herein, it will be appreciated that changes and variations may be made by those skilled in the art without departing from the spirit and scope of the appended claims. The invention is defined by the claims that follow.

What is claimed is:

1. An adjustable support for securing a manufactured building or the like to an underlying foundation comprising:

a plurality of support bolts adapted to be vertically fixed in the foundation;

a stanchion;

connector means on said stanchion adjacent the top thereof for rigid connection to said building;

mounting means secured to said stanchion adjacent the bottom thereof and cooperating with said support bolts whereby said stanchion adjacent the top thereof may be moved vertically, horizontally and angularly relative to said bolts and responsive to the stresses of the building acting on said stanchion; and positioning means mounted on each of said support bolts for adjusting and locking said stanchion in any selected position.

2. The adjustable support of claim 1 in which there are three of said support bolts arranged in a triangle so that said bolts circumscribe said stanchion.

3. The adjustable support of claim 2 in which said mounting means comprises:

a plate rigidly secured to said stanchion; and three mounting holes formed in said plate and accommodating said support bolts therethrough, the cross-sectional area of said mounting holes being substantially greater than the cross-sectional area of said bolts.

4. The adjustable support of claim 3 in which said positioning means comprises a support nut and washer adapted to bear against the bottom surface of said plate and a lock nut and washer adapted to bear against the top surface of said plate.

5. The adjustable support of claim 3 in which said plate has a side margin around said stanchion with said mounting holes being formed in said margin.

6. The adjustable support of claim 5 in which said mounting holes are formed in said margin whereby said mounting holes define a triangle.

7. The adjustable support of claim 6 in which said connector means comprises a rigid tongue fixedly mounted on said stanchion adjacent the top thereof so that a portion of said tongue projects thereabove, said projecting portion being adapted for tight engagement with the main frame of the building.

8. The adjustable support of claim 7 in which said stanchion comprises a rectangular tube and said plate comprises a complementary rectangle, said tongue being mounted on the stanchion end wall proximal to an end margin of said plate having two mounting holes formed therein.

9. An adjustable support for attachment to the I-beam of a mobile home or the like for securing the home to an underlying concrete foundation comprising:

a rectangular stanchion having a pair of end walls and a pair of side walls;

a connector tongue rigidly mounted on one of said end walls with a portion projecting thereabove and adapted to be bent inwardly into tight clamping engagement with said I-beam so that said stanchion side walls are transverse to the longitudinal axis of said I-beam;

a rectangular mounting plate rigidly secured to the bottom of said stanchion and having complementary end margins and side margins;

a pair of mounting holes formed in the end margin associated with said one stanchion end wall and adjacent the opposite ends of said end margin;

a third mounting hole formed in the opposite end margin at the approximate mid-point thereof so that said mounting holes define a substantially isosceles triangle;

a threaded support rod slidably positioned through each of said mounting holes, the lower portions of said support rod being adapted to be fixedly embedded vertically in said concrete foundation, the diameter of said mounting holes being substantially greater than the diameter of said support rods whereby said stanchion can move vertically, horizontally and angularly relative to said rods and responsive to the weight stresses of the mobile home acting on said stanchion; and positioning means threadedly mounted on each of said support rods for adjusting and locking said stanchion in any selected position to achieve a substantial equilibrium state between said support rods and I-beam.

10. The adjustable support of claim 9 in which said positioning means comprises a support nut and washter adapted to bear against the bottom of said mounting plate and a lock nut and washer adapted to bear against the top of said mounting plate.

* * * * *